US005647279A

United States Patent [19]

Johner et al.

[11] Patent Number: 5,647,279

[45] Date of Patent: Jul. 15, 1997

[54] PRINTING MACHINE ROLLER AND METHOD OF PRODUCTION THEREOF

[75] Inventors: Gerhard Johner, Gelnhausen; Stefan Hasenzahl, Darmstadt; Juergen Kern, Mauer, all of Germany

[73] Assignee: Heidelberger Druckmaschinen AG, Heidelberg, Germany

[21] Appl. No.: 500,044

[22] Filed: Jul. 10, 1995

Related U.S. Application Data

[63] Continuation-in-part of Ser. No. 117,601, Sep. 7, 1993, abandoned.

[30] Foreign Application Priority Data

Sep. 5, 1992 [DE] Germany ..... 42 29 700.1

[51] Int. Cl.[6] ..... B41C 1/02

[52] U.S. Cl. ..... 101/401.1; 101/375; 101/148; 492/28; 492/53; 492/54; 427/255.3; 427/376.2; 118/723 R; 118/723 CB; 118/723 EB

[58] Field of Search ..... 101/483, 401.1, 101/348, 375, 148, 147; 427/248.1, 249, 255, 255.3, 371.2; 428/262; 118/723 R, 723 CB, 723 EB; 492/28, 53, 54

[56] References Cited

U.S. PATENT DOCUMENTS

| | | | |
|---|---|---|---|
| H1166 | 4/1993 | Kim et al. | 427/255.3 |
| 2,908,068 | 10/1959 | Biel et al. . | |
| 3,649,189 | 3/1972 | Kugler et al. | 101/401.1 |
| 3,705,451 | 12/1972 | Dahlgren . | |
| 3,901,147 | 8/1975 | Holland . | |
| 3,902,885 | 9/1975 | Rau | 65/302 |
| 4,069,570 | 1/1978 | Pospisil . | |
| 4,225,356 | 9/1980 | Prochazka et al. | 101/401.1 |
| 4,351,858 | 9/1982 | Hunold et al. | 427/376.2 |
| 4,466,380 | 8/1984 | Jansen et al. | 118/723 R |
| 4,566,938 | 1/1986 | Jenkins et al. . | |
| 4,789,389 | 12/1988 | Schermerhorn et al. | 65/3.12 |
| 4,887,528 | 12/1989 | Ruge et al. . | |
| 4,960,050 | 10/1990 | Hatch . | |
| 4,963,404 | 10/1990 | Jenkins . | |
| 4,991,501 | 2/1991 | Yokoyama et al. . | |
| 5,093,180 | 3/1992 | Morgan | 101/348 |
| 5,188,032 | 2/1993 | Lewis et al. . | |
| 5,296,288 | 3/1994 | Kourtides et al. | 428/262 |
| 5,298,296 | 3/1994 | Kojima et al. | 427/255.3 |

FOREIGN PATENT DOCUMENTS

| | | |
|---|---|---|
| 0396114 | 11/1990 | European Pat. Off. . |
| 0400621 | 12/1990 | European Pat. Off. . |
| 0412219 | 2/1991 | European Pat. Off. . |
| 0514640 | 11/1992 | European Pat. Off. . |
| 0528232 | 2/1993 | European Pat. Off. . |
| 0164081 | 2/1982 | German Dem. Rep. . |
| 2458508 | 6/1975 | Germany . |
| 1525558 | 9/1978 | United Kingdom . |

OTHER PUBLICATIONS

Japanese Patent Abstract No. 61–179796 Kamaishi et al., Feb. 6, 1985.

*Primary Examiner*—Eugene H. Eickholt

*Attorney, Agent, or Firm*—Herbert L. Lerner; Laurence A. Greenberg

[57] ABSTRACT

The hydrophilic properties of a printing-machine roller are adjusted with a coating applied on an outer surface of its cylindrical body. The coating contains at least 45% by weight of pure silicon, or it is formed exclusively of chemically pure silicon. The coating is between 0.2 and 2 mm thick and its surface roughness $R_z$ is no more than 5 μm.

22 Claims, 2 Drawing Sheets

PRINTING MACHINE ROLLER AND METHOD OF PRODUCTION THEREOF

CROSS-REFERENCE TO RELATED APPLICATION

This application is a continuation-in-part of application Ser. No. 08/117,601, filed Sep. 7, 1993, now abandoned.

BACKGROUND OF THE INVENTION

Field of the Invention

The invention relates to a printing-machine roller, especially a dampening-unit roller, and preferably a metering roller having an outer cylindrical surface with a coating provided thereon.

In mechanical construction engineering, a demand exists for surface-coated cylinders which must have a coating with a hydrophilic property. In printing technology, for example, a dampening unit of a printing machine is equipped with a plurality of rollers by means of which a dampening-medium film which is as thin and uniform as possible is applied to a printing form of a printing-form cylinder. A particularly thin and uniform distribution of the dampening medium ensures a good print quality. Moreover, it is important that the feeding of the dampening medium take place without any introduction of printing ink into the dampening unit. With arrangements in which the inking-unit rollers of the printing machine are connected to the dampening-unit rollers via at least one intermediate roller, it is particularly critical if printing ink should enter the dampening unit.

The better the hydrophilic property of the surface of the printing-unit roller (dampening-unit roller) is, the thinner and more uniform is the formation of the dampening-medium film thereon.

Top-grade printing, for example, art printing, requires mostly an extremely thin dampening-medium film, for example, 5 μm thick, surrounding the entire outer cylindrical surface of the roller. To form such a thin dampening-medium film, it has heretofore been necessary to admix alcohol or alcohol substitutes to the dampening medium in order to reduce the surface tension. Isopropanol or ethanol, for example, are used as the alcohol. For reasons of environmental protection and/or due to the regulations for the prevention of accidents it is to be expected that, in the future, a reduction in the use of alcohol or alcohol substitutes may be suggested or even required by law. At the same time, there remains a demand for top-grade prints for which an extremely thin and uniform layer of dampening medium is a prerequisite.

Heretofore, in addition to special wetting agents (alcohols), specific surface materials which have been subjected to a selective treatment have been used in order to obtain the best possible hydrophilic properties for the printing-machine rollers. It is has become known heretofore to use ground and/or polished stainless steel as surface material for such dampening-unit rollers. Moreover, it has become known heretofore to galvanically deposit onto the surface of rollers or cylinders a chromium layer which is then ground and/or polished. In connection with the use of alcohols or alcohol substitutes admixed in the dampening medium, good print results have been obtained with the dampening-unit rollers described hereinbefore. If the amount of alcohol or the amount of the alcohol substitute is reduced, however, the print results are no longer satisfactory.

It is therefore an object of the invention to provide a printing-machine roller of the foregoing general type which has exceptionally good hydrophilic properties.

SUMMARY OF THE INVENTION

With the foregoing and other objects in view, there is provided, in accordance with the invention, a printing-machine roller, comprising a cylindrical body formed with an outer cylindrical surface having a coating applied thereto, said coating containing at least 45% by weight pure silicon, having a thickness of between 0.2 and 2 mm, and having a surface roughness $R_z \leqq 5$ μm.

In accordance with an added feature of the invention, the coating consists essentially of chemically pure silicon.

The coating according to the invention brings about an extremely small contact angle of alcohol-free dampening medium. The contact angle is the angle formed by the secant at a dampening-medium drop and a plane surface on which the drop is located. Due to the extremely small contact angle it unnecessary or hardly necessary to reduce the surface tension of the dampening medium by adding alcohol or alcohol substitutes, because an extremely thin and uniform dampening-medium film is created without alcohol or alcohol substitutes being added. Only one roller or a plurality of rollers of a printing machine and of the dampening unit of the printing machine, respectively, may be coated with the material according to the invention.

It is especially advantageous to provide the metering roller of the dampening unit with the coating according to the invention. As a protection against corrosion and/or to enhance the adhesive behavior between the cylinder surface (outer cylindrical surface) and the coating, an intermediate layer of nickel and/or chromium and/or aluminum and/or boron and/or silicon and/or titanium and/or molybdenum or similar material can be applied. The layer is preferably applied by the following methods: thermal spraying, physical vapor deposition, chemical vapor deposition, plasma chemical vapor deposition or galvanizing.

The word "containing" as employed herein leaves open the possibility that, in addition to silicon metal, other substances may be included in the coating. In contrast therewith, the term "consisting of" is meant to restrict the material of the coating to metallic silicon only, while the modified "consisting essentially of" expresses the possibility of the presence of otherwise unimportant impurities often retained from the precursor materials.

In accordance with another feature of the invention, the roller is a dampening-unit roller, such as a metering roller.

In accordance with an added feature of the invention, the coating is formed of a thermally applied layer of silicon-metal powder.

In accordance with yet a further feature of the invention, the surface roughness is $Rz \leqq 1.0$ μm.

In accordance with yet an added feature of the invention, the coating is a deposition-layer selected from the group consisting of physical vapor deposition-layer, electron beam physical vapor deposition-layer, chemical vapor deposition-layer, and plasma chemical vapor deposition-layer.

In accordance with an added alternative feature of the invention, the coating is a sintered layer.

In accordance with an additional alternative feature of the invention, the coating is a hot isostatic pressing-layer.

In accordance with yet another alternative feature of the invention, the coating is a galvanic-layer.

In accordance with another feature of the invention, the cylindrical body is formed of metal.

With the foregoing and other objects in view there is also provided, in accordance with the invention, a method of coating the rotatable cylindrical body of the printing machine having an outer cylindrical surface. The method comprises applying a coating containing at least 45% by weight of pure silicon to the outer cylindrical surface of the cylindrical body.

In accordance with a further mode of the invention, the coating is chosen to consist essentially of chemically pure silicon.

In accordance with another mode of the method invention, the silicon metal or silicon-metal powder or the substance containing the silicon is applied to the outer cylindrical surface by a thermal spraying process.

In accordance with a further mode, the method of the invention includes treating the outer surface of the layer to reduce surface roughness.

In accordance with an added mode of the method according to the invention, the treatment includes grinding the surface of the layer.

In accordance with an additional mode of the method according to the invention, the treatment includes at least one of grinding and polishing the surface of the layer.

In accordance with an additional mode, the method according to the invention includes impregnating the outer surface of the layer with a pore-sealing agent in order to reduce the porosity of the layer.

Thus, the surface roughness can be produced by a suitable treatment of the silicon-metal coating, in particular by grinding, polishing, and pore-sealing after-treatment (e.g. through an anaerobically curing gumming process).

In accordance with yet another mode of the method according to the invention, the processing of the surface of the layer is to a roughness $Rz \leqq 1.0$ μm.

In accordance with yet a further mode of the method according to the invention, the processing includes at least one of grinding, polishing and abrading with a basic agent the surface of the the layer. The surface of the coating is abraded, particularly after the aforementioned leveling treatment (such as grinding and/or polishing) with the aid of a basic agent, especially a slightly basic cleaning liquid. In so doing, the surface is activated and causes the formation of a hydrophilic layer.

In accordance with yet an added mode of the method according to the invention, the basic agent is a weakly basic cleaning liquid.

In accordance with yet an additional mode, the method according to the invention includes setting the surface roughness of the layer consisting of or containing silicon metal so that a dampening medium free of any added alcohol and/or alcohol substitute applied to the layer for use in a printing process has a contact angle <50°, and particularly <35°.

In accordance with a concomitant aspect of the invention, there is provided a method of producing a printing-machine roller with a coating having hydrophilic properties, which comprises applying a coating of silicon metal or a substance containing silicon metal to the outer cylindrical surface of a roller body.

Other features which are considered as characteristic for the invention are set forth in the appended claims.

Although the invention is illustrated and described herein as embodied in a printing-machine roller and a method of production thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
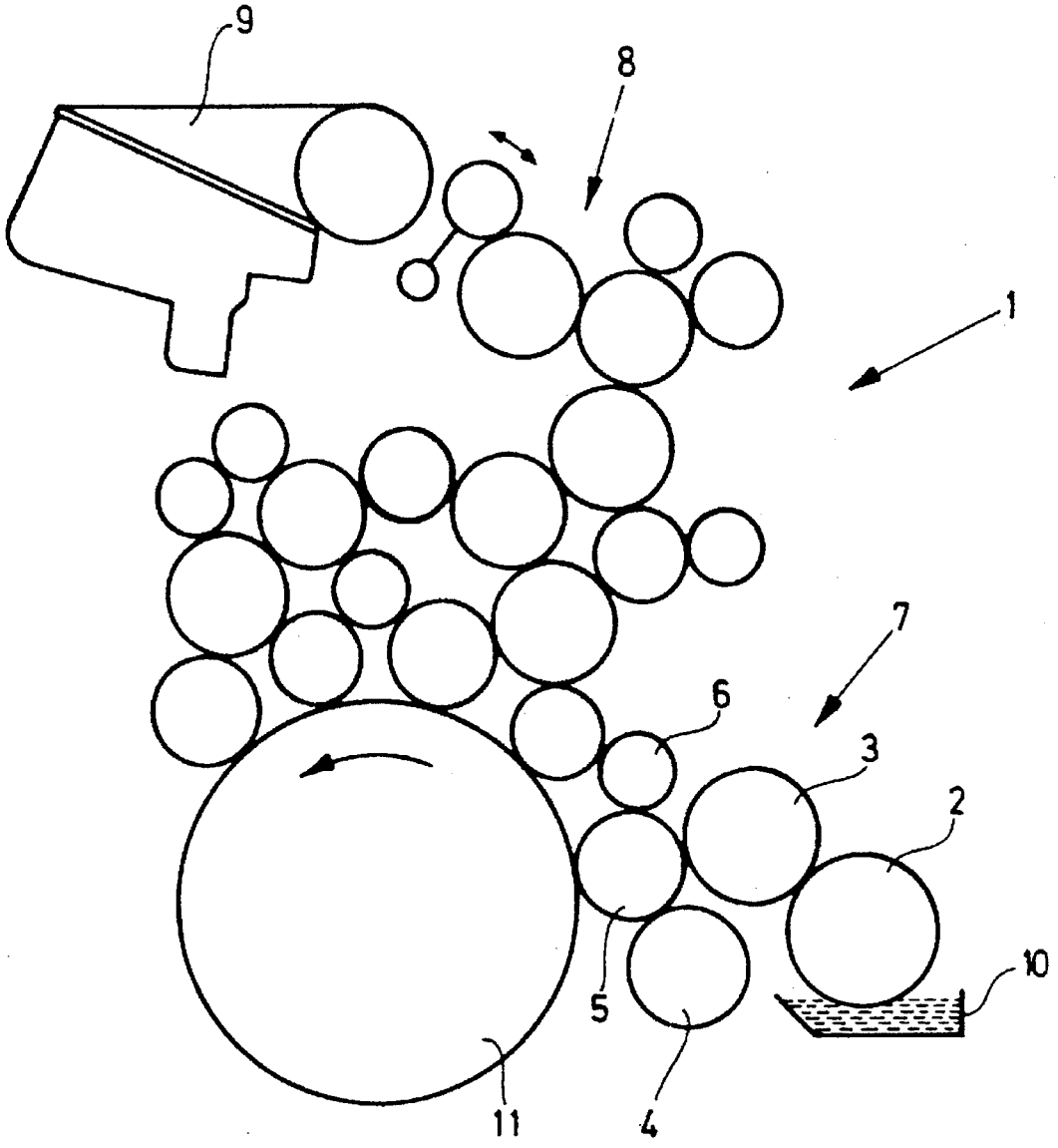
FIG. 1 is a diagrammatic and schematic view of the rollers of an offset printing machine.

Referring now to the drawing and, first, particularly to FIG. 1 thereof, there is shown therein a printing-unit roller array 1 of an offset printing machine. Rollers 2 through 6 thereof are part of a dampening unit 7 and the other rollers shown at the top of FIG. 1 are part of an inking unit 8. The roller 6 is an intermediate roller via which the dampening unit 7 and the inking unit 8 are connected to each other. An ink duct or fountain 9 from which printing ink is supplied is assigned to one of the rollers of the inking unit 8. In the dampening unit 7, a water pan 10, from which dampening medium (dampening water) is taken and fed to a roller 3 constructed as a metering roller, is assigned to the roller 2 which is constructed as a dipping roller. The roller 3 rolls off on the roller 5 which is constructed as a rubber-covered roller cooperating with the roller 4 which performs as a distributor cylinder. The roller 5 transfers the dampening medium in the form of a thin and uniform film onto a plate cylinder 11 carrying a printing form on the circumference or outer cylindrical surface thereof. In the interest of simplicity, other rollers or cylinders, such as a blanket cylinder and the like are not illustrated in FIG. 1.

At least one of the rollers, namely the metering roller 3, is provided with a coating having excellent hydrophilic properties so that an extremely thin and uniform dampening-medium film is formed without having to add any alcohol or alcohol substitutes or, at most, having to add only considerably reduced amounts of alcohol or alcohol substitutes. The alcohol, which usually has 10 to 15 per cent by volume of concentration, is thus reduced to a considerably lower percentage or is totally dispensed with. This is of great importance with respect to the regulations for preventing accidents and for environmental protection.

The invention is not limited, however, to the arrangement of rollers of the dampening unit 7 as represented in FIG. 1, but rather, to any type of printing-machine rollers, provided that the rollers have hydrophilic properties.

Figure 2:
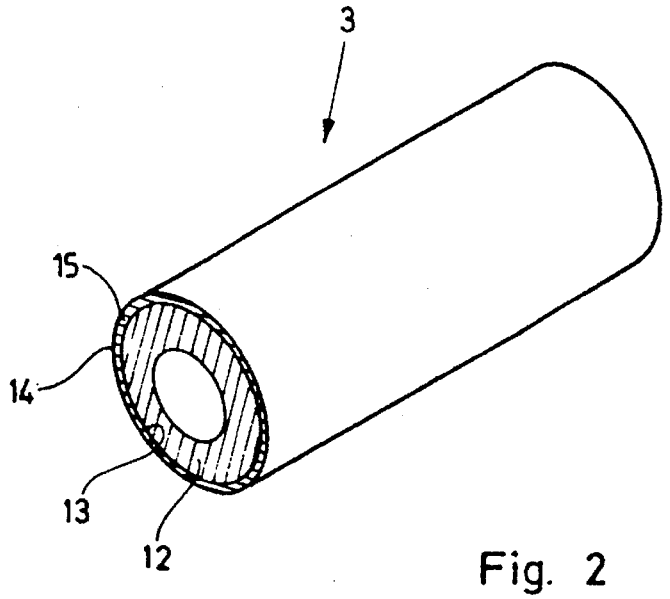
FIG. 2 is a fragmentary perspective view, partly cut-away and in cross section, of a coated dampening-unit roller constructed in accordance with the invention.

FIG. 2 offers a cross-sectional perspective view of the roller 3 (metering roller). The roller 3 is formed of a hollow cylindrical body 12 made of metal and having an outer cylindrical surface 13 which is provided with a coating 14. The coating 14 contains silicon metal or, according to another embodiment of the invention, consists of silicon metal.

In a thermal spraying process, preferably pure silicon-metal powder is applied as a very pore-free, preferably approximately 1 mm-thick layer or coating. Then, the coating 14 is mechanically ground and polished until a roughness Rz of approximately 1.0 μm, in particularly ≦1.0 μm, is attained. If necessary or desirable, the surface is then submitted to a pore-sealing after-treatment. The thus produced surface has excellent hydrophilism. This hydrophilism is reproducible and remains in perfect condition, even after the surface has dried.

After the polishing process and prior to the first use of the coating 14, the surface thereof is preferably abraded with a slightly basic cleaning liquid. In so doing, the surface is activated, with the formation of a hydrophilic layer.

Figure 3:
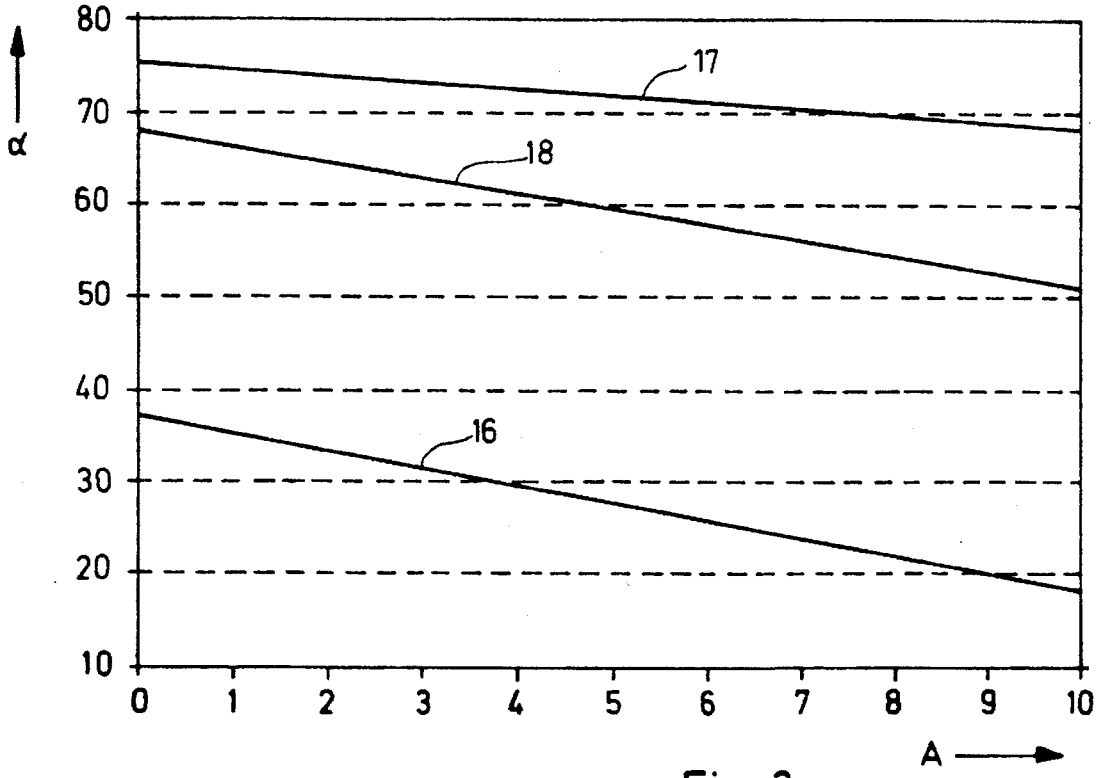
FIG. 3 is a plot diagram of the contact angle of a coating of dampening medium at the surface of the roller plotted against isopropanol content in the dampening medium.

According to the method of the invention, a coating 14 of a dampening-unit roller onto which dampening medium containing no alcohol and/or alcohol substitutes is applied has a contact angle which is smaller than 40° (note FIG. 3).

The plot diagram in FIG. 3 shows the contact angle α at the surface of the metering roller (roller 3) which is coated in the aforedescribed manner in accordance with the invention. In the diagram, the contact angle α indicated in degrees is presented as a function of the amount of isopropanol A plotted on the abscissa in percent-by-volume concentration. With the coating according to the invention, a functional relationship with respect to line 16 is produced. The diagram clearly shows an extremely low contact angle α, even if no alcohol is added. In comparison therewith, FIG. 3 also shows contact-angle values of dampening-unit rollers with conventional surfaces. Thus, line 17 indicates the result produced by a chromium-plated roller. Finally, line 18 reveals the result produced by a dampening-unit roller having a stainless-steel surface.

Especially advantageous is the fact that a silicon-metal coating applied in a thermal spraying process can be ground and polished very quickly and easily to a roughness Rz of approximately 1.5 μm, and preferably 1.0 μm. It is readily possible to obtain, with such a coating 14, a dampening-medium film having a thickness of 5 μm, for example, even without adding a wetting agent to the dampening medium, so that a perfect print is produced without any tearing of the dampening-medium film.

In addition to the aforementioned thermal spraying method, further methods of applying the coating 14 onto the outer cylindrical surface 13 of a respective cylinder 12 are conceivable. It is advantageous to use the following methods: physical vapor deposition, electron beam physical vapor deposition, chemical vapor deposition, plasma chemical vapor deposition, sintering, hot isostatic pressing and/or galvanizing.

The range limitation of 45% by weight of metallic silicon has been found to be a critical limit, with a lesser amount of silicon having exhibited substantially inferior result in terms of wettability, hydrophilism and contact angle. Pure silicon dioxide $SiO_2$, which has a stoichimetric silicon content of 46.74% by weight, has been found to exhibit promising results as well and it falls within the range of at least 45% by weight.

We claim:

1. A printing-machine roller, comprising a cylindrical body formed with an outer cylindrical surface having a coating applied thereto, said coating containing at least 45% by weight pure silicon, having a thickness of between 0.2 and 2 mm, and having a surface roughness $R_z$≦5 μm.

2. The printing machine roller according to claim 1, wherein said coating consists essentially of chemically pure silicon.

3. The printing-machine roller according to claim 1, wherein the roller is a dampening-unit roller.

4. The printing-machine roller according to claim 3, wherein the dampening-unit roller is a metering roller.

5. The printing-machine roller according to claim 1, wherein the coating is formed of a thermally applied layer of silicon-metal powder.

6. The printing-machine roller according to claim 1, wherein the surface roughness is Rz≦1.0 μm.

7. The printing-machine roller according to claim 1, wherein said coating is a deposition-layer selected from the group consisting of physical vapor deposition-layer, electron beam physical vapor deposition-layer, chemical vapor deposition-layer, and plasma chemical vapor deposition-layer.

8. The printing-machine roller according to claim 1, wherein said coating is a sintered layer.

9. The printing-machine roller according to claim 1, wherein said coating is a hot isostatic pressing-layer.

10. The printing-machine roller according to claim 1, wherein said coating is a galvanic-layer.

11. The printing-machine roller according to claim 1, wherein said cylindrical body is formed of metal.

12. A method of coating a rotatable cylindrical body of a printing machine having an outer cylindrical surface, which comprises applying a coating containing at least 45% by weight of pure silicon to the outer cylindrical surface of the cylindrical body, and processing the outer surface of the layer to reduce surface roughness.

13. The method according to claim 12, which further comprises selecting the coating to consist essentially of chemically pure silicon in the applying step.

14. The method according to claim 12, wherein the applying step comprises a thermal spraying process during which one of silicon metal, silicon-metal powder, and a substance containing silicon metal is sprayed on the outer cylindrical surface.

15. The method according to claim 12, wherein the processing includes grinding the surface of the layer.

16. The method according to claim 12, wherein the processing includes at least one of grinding and polishing the surface of the layer.

17. The method according to claim 12, wherein the processing of the surface of the layer is to a roughness Rz≦1.0 μm.

18. The method according to claim 12, wherein the processing includes at least one of grinding, polishing and abrading with a basic agent the surface of the layer.

19. The method according to claim 18, wherein the basic agent is a weakly basic cleaning liquid.

20. The method according to claim 12, which includes setting the surface roughness of the layer so that a dampening medium free of any added alcohol and/or alcohol substitute applied to the layer for use in a printing process has a contact angle <50°.

21. The method according to claim 12, which includes setting the surface roughness of the layer so that a dampening medium free of any added alcohol and/or alcohol substitute applied to the layer for use in a printing process has a contact angle <35°.

22. A method of coating a rotatable cylindrical body of a printing machine having an outer cylindrical surface, which comprises applying a coating containing at least 45% by weight of pure silicon to the outer cylindrical surface of the cylindrical body, and impregnating the outer surface of the layer with a pore-sealing agent in order to reduce the porosity of the layer.

* * * * *